US006457637B1

(12) United States Patent
Fritz et al.

(10) Patent No.: US 6,457,637 B1
(45) Date of Patent: Oct. 1, 2002

(54) COMBINATION SHIPPING CARTON AND DISPLAY UNIT

(75) Inventors: Gary R. Fritz, St. Marys, PA (US); James J. Salvamoser, Kane, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/067,676

(22) Filed: Feb. 5, 2002

(51) Int. Cl.[7] ..... B65D 5/54
(52) U.S. Cl. ..... 229/240; 206/736; 206/774
(58) Field of Search ..... 229/236, 240; 206/45.21, 45.23, 45.25, 736, 745, 746, 774

(56) References Cited

U.S. PATENT DOCUMENTS 2,862,612 A * 12/1958 Brown ..... 229/240
3,360,182 A * 12/1967 Gunn ..... 206/746
3,372,794 A * 3/1968 Kohlhaas ..... 229/240
3,884,348 A * 5/1975 Ross ..... 206/746
4,284,193 A * 8/1981 Roccaforte ..... 229/240
5,036,981 A * 8/1991 Johansson ..... 229/240
5,364,020 A * 11/1994 Bansal ..... 229/240

* cited by examiner

*Primary Examiner*—Gary E. Elkins
(74) *Attorney, Agent, or Firm*—William H. McNeill

(57) ABSTRACT

A production blank 10 for forming a parallelepipedonal shipping and display carton has a plurality of spaced apart tear lines and fold lines. A first flap 12 joins to a cover 14 by a tear line 16 on a first edge of the cover. A front side 18 joins the cover 14 on a second edge of the cover 14 by a fold line 19. A bottom 20 joins the first side on a second edge of the side 16 by a tear line 22. A back side 24 is joined to the bottom on a second edge of the bottom by a fold line 26; and a plurality of lateral flaps 28, 28'attached to the top, and 30, 30' attached to the bottom and 32, 32' and 34, 34' attached, respectively, to the front and back sides. The lateral flaps form opposite sides of the parallelepipedon. All of the lateral flaps are attached by fold lines and at least some of the lateral flaps have glue thereon. The blank is folded and glued to form the carton for shipping purposes and upon arrival at its final destination it separated along the tear lines to form a display carton.

4 Claims, 3 Drawing Sheets

COMBINATION SHIPPING CARTON AND DISPLAY UNIT

TECHNICAL FIELD

This invention relates to a shipping carton and more particularly to such a carton that, upon arrival at its ultimate destination, can be used to display its contents.

BACKGROUND ART

Under the usual conditions that pertain to the shipping and delivery of saleable items, a carton of the items is delivered to a display area, the carton is opened and the items removed and arrayed, usually upon a shelf. The empty carton is then discarded. Such actions are time consuming and add to the cost of the displayed items. It would, therefore, be an advance in the art if a combination shipping and display carton could be provided that would allow the shipped items to be displayed without removal from the carton.

DISCLOSURE OF INVENTION

It is, therefore, an object of the invention to obviate the disadvantages of the prior art.

It is another object of the invention to provide a shipping and display carton that is manufactured from a single production blank.

These objects are accomplished, in one aspect of the invention, by providing a production blank from which a combination shipping and display carton can be manufactured. The production blank comprises: a first flap joined to a cover by a tear line on a first edge of the cover; a front side joined to the cover on a second edge of the cover by a fold line; a bottom joined to the first side on a second edge of the side by a tear line; a back side joined to the bottom on a second edge of the bottom by a fold line; and a plurality of lateral flaps attached to the top, bottom and, respectively, to the front and back sides, the lateral flaps forming opposite sides of the carton, all of the lateral flaps being attached by fold lines and at least some of the lateral flaps having glue thereon.

When folded and glued to form the shipping carton the carton has a parallelepipedonal configuration. When delivered to its final destination, the carton is separated along its two tear lines, leaving a display unit having a bottom, two half sides and a back.

BRIEF DESCRIPTION

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
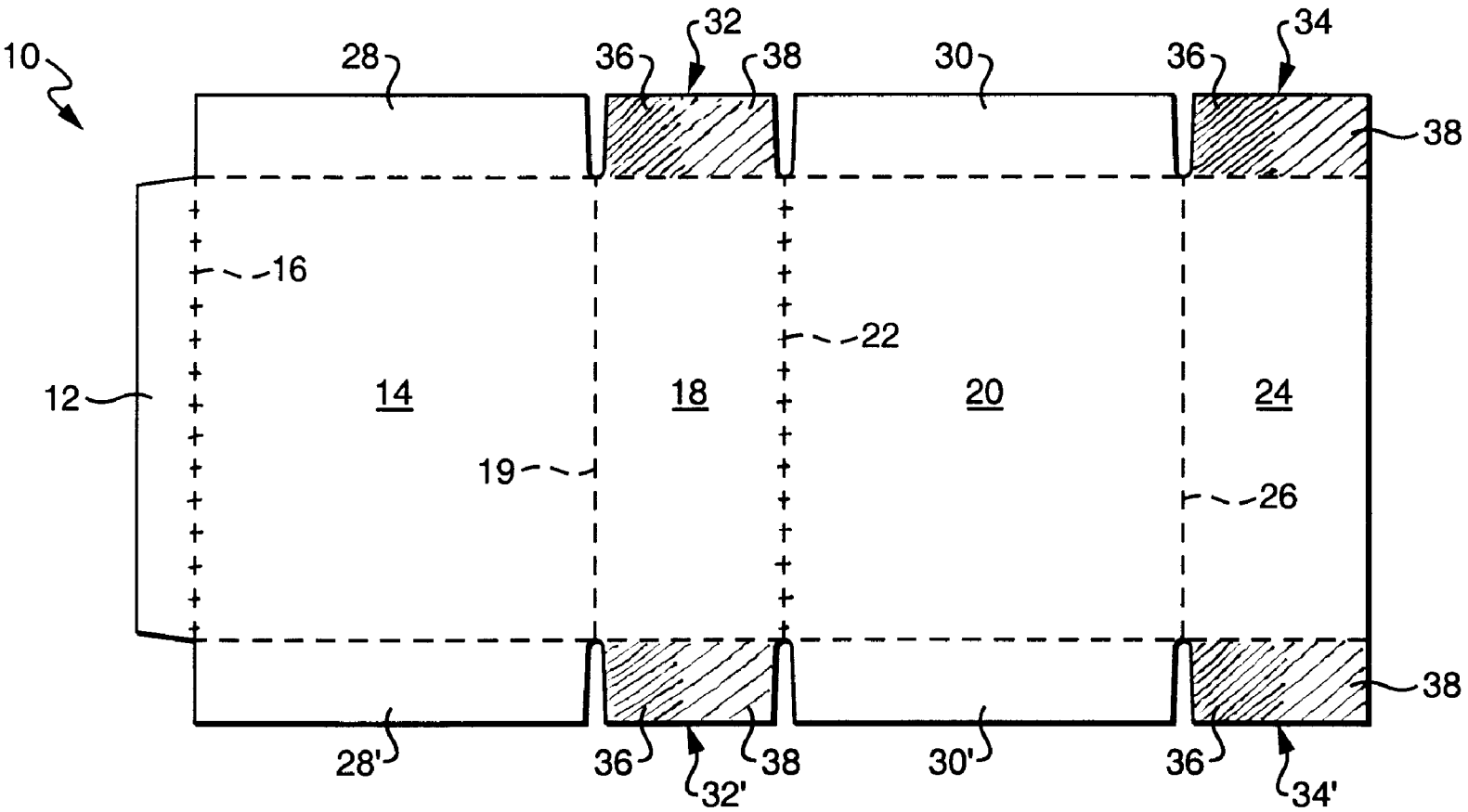
FIG. 1 is a plan view of the production blank of the invention.

Referring now to the drawings with greater particularly, there is shown in FIG. 1 a production blank 10 for forming a parallelepipedonal shipping and display carton. In a preferred embodiment of the invention the blank 10 is constructed of a suitable corrugated cardboard of sufficient strength to adequately hold the shipped items. The corrugations preferably run lengthwise of the blank. The production blank 10 has a plurality of spaced apart tear lines and fold lines, with the tear lines perforated to allow subsequent easy separation of the carton into two distinct parts. A first slap 12 is joined to a cover 14 by a tear line 16 on a first edge of the cover. A front side 18 is joined to the cover 14 on a second edge of the cover 14 by a fold line 19. A bottom 20 is joined to the first side on a second edge of side 16 by a tear line 22. A back side 24 is joined to the bottom 20 on a second edge by a fold line 26. A plurality of lateral flaps is attached to the top, sides, and bottom. These are designated in the drawings as flaps 28, 28' attached to the top; 30, 30' attached to the bottom and 32, 32' and 34, 34' attached, respectively, to the front and back sides. The lateral flaps cooperate to form opposite sides of the parallelepipedonal carton when it is assembled.

All of the lateral flaps are attached by fold lines and the flaps associated with the front side 18 and the back side 24, i.e., flaps 32 and 32' and 34 and 34' are provided with a particular glue pattern. That is, these latter flaps are each divided into two areas, 36 and 38. Areas 36 are each provided with a heavy amount of glue and areas 38 are provided with a lighter amount of glue. Additionally, the first flap 12 is provided with a heavy amount of glue. As used herein, the term heavy amount of glue means that amount of glue necessary to permanently bind parts together while the term lighter amount of glue refers to that amount of glue necessary to temporarily bind parts together, for purposes that will become readily apparent hereinafter. As one skilled in the art will be aware, the actual amount of glue employed for either area will be dependent upon the type of glue used as well as the type of material to which it is being applied. Further, it is not necessary that the glue for both areas be the same, as different types of glue may provide the same benefit.

Figure 2:
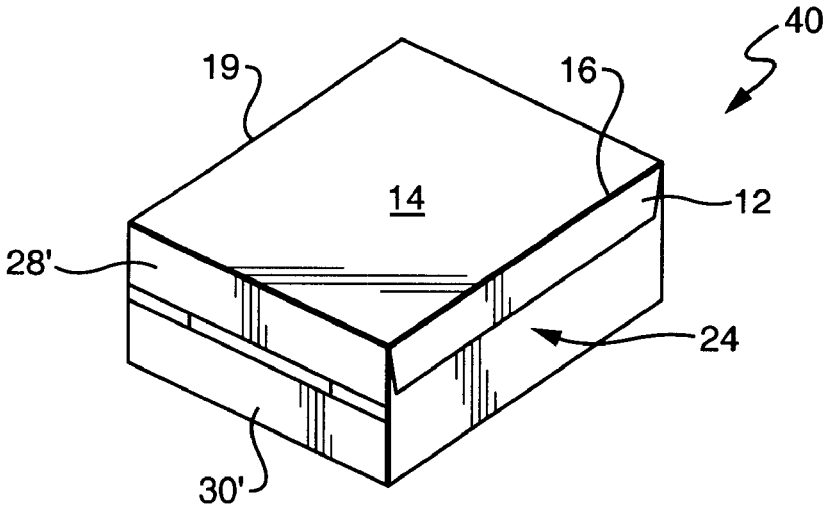
FIG. 2 is a perspective view of a carton assembled from the blank of FIG. 1.

As assembled carton 40 is illustrated in FIG. 2. First flap 12 is sealed to back side 24 and the lateral flaps 28, 32, 30, and 34, and 28', 32', 30', and 34' are glued together to make up the opposite sides of the parallelepipedonal carton 40.

Upon delivery to its final destination, carton 40 is opened by separating the cover 14 from the first flap 12 at tear lines 16. Lateral flaps 28' and 28 peel away from the light glue area 38 on flaps 34 and 34' while lateral flaps 30 and 30' remain attached to the heavy glue area 36.

Figure 3:
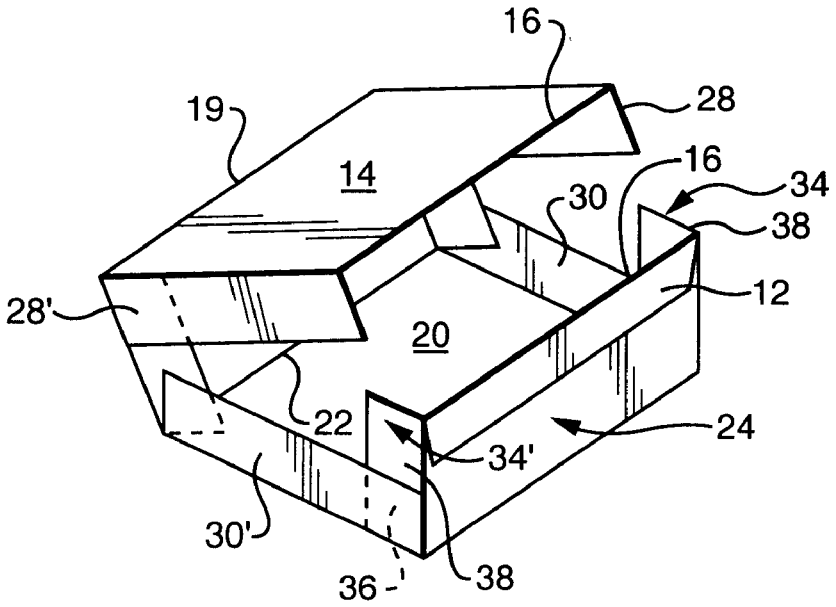
FIG. 3 is a perspective view of the carton partially opened.
Figure 4:
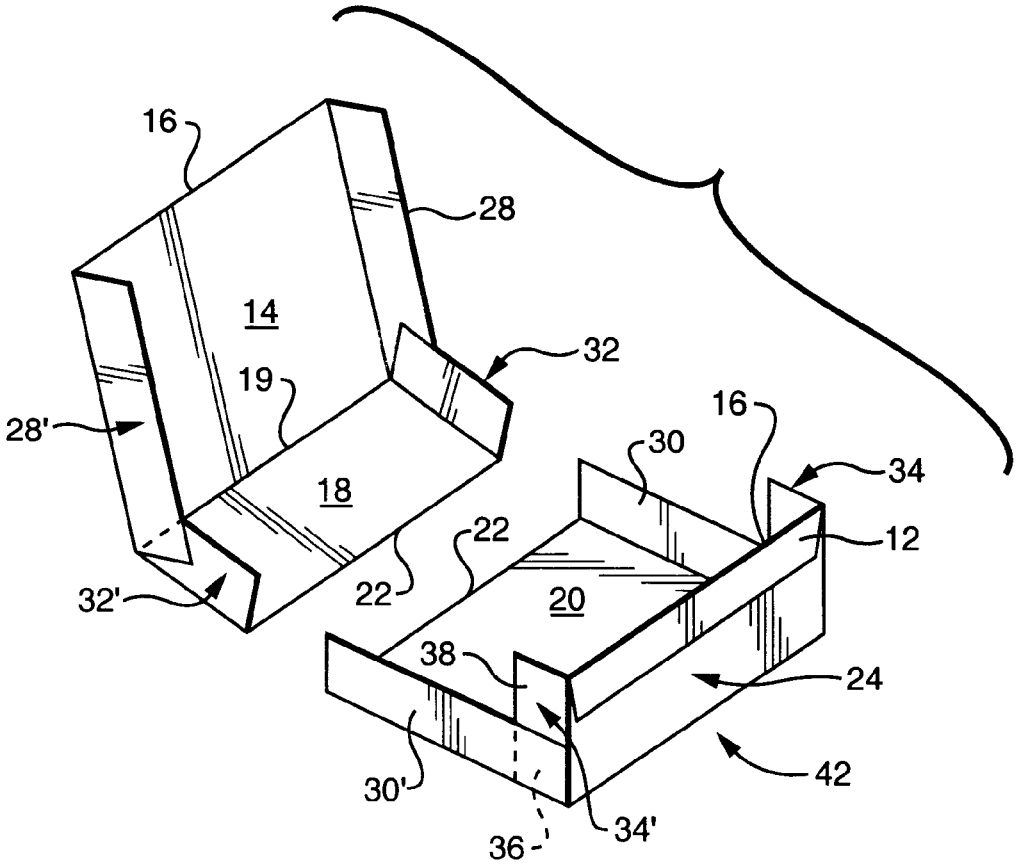
FIG. 4 is an exploded perspective view of the carton prepared as a display unit.

As the cover 14 and front side 18 are folded away from the main body (FIG. 3), tear line 22 is exposed and allows complete separation of cover 14 and front side 18 from carton 40, leaving a display portion 42 of carton 40.

This combination shipping and display carton is easy to use and economical to manufacture.

While there have been shown and described what are at present considered to be the preferred embodiments of the invention, it will be apparent to those skilled in the art that various changes and modification can be made herein without departing from the scope of the invention as defined by the appended claims.

What is claimed is:

1. In a production blank for forming a parallelepipedonal shipping and display carton, the improvement comprising: a first flap joined to a cover by a first tear line on a first edge of said cover; a front side joined to said cover on a second edge of said cover by a first fold line, a bottom joined to said first side on a second edge of said side by a second tear line, a back side joined to said bottom on a second edge of said bottom by a second fold line; and a plurality of lateral flaps attached to said cover, to said bottom and to said front and back sides, said lateral flaps forming opposite sides of said parallelepipedonal shipping and display carton, all of said lateral flaps being attached by fold lines and at least some of said lateral flaps having glue thereon.

2. The production blank of claim 1 wherein said flaps having glue thereon are attached to said sides.

3. The production blank of claim 1 wherein said first flap has glue thereon.

4. The production blank of claim 2 wherein said lateral flaps attached to said sides have two areas, a first of said areas being supplied with a heavy amount of glue and the second of said areas being supplied with a light amount of glue.

* * * * *